United States Patent [19]

Ono

[11] Patent Number: 4,493,152

[45] Date of Patent: Jan. 15, 1985

[54] LETTERING MACHINE

[75] Inventor: Osamu Ono, Tokyo, Japan

[73] Assignee: Nakuru Inc., Tokyo, Japan

[21] Appl. No.: 529,677

[22] Filed: Sep. 6, 1983

[51] Int. Cl.[3] ..... B43L 13/10

[52] U.S. Cl. ..... 33/25 R; 33/18 C; 33/1 K; 33/20 C; 33/23 C

[58] Field of Search ..... 33/18 B, 1 K, 18 C, 33/20 R, 20 C, 23 C, 23 E, 23 F, 23 H, 25 R, 25 B, 22, 18 R, 24 R

[56] References Cited

U.S. PATENT DOCUMENTS

| | | | |
|---|---|---|---|
| 2,559,222 | 7/1951 | Moore | 33/18 C |
| 2,807,878 | 10/1957 | Woods | 33/24 R |
| 3,269,014 | 8/1966 | Gase | 33/18 C |
| 3,298,262 | 1/1967 | Serafino | 33/25 R |
| 3,777,616 | 12/1973 | Mueller | 33/23 C |

FOREIGN PATENT DOCUMENTS

| | | | |
|---|---|---|---|
| 057663 | 3/1890 | Fed. Rep. of Germany | 33/18 C |

*Primary Examiner*—Willis Little
*Attorney, Agent, or Firm*—Patrick H. Hume

[57] ABSTRACT

A lettering machine is disclosed, which comprises a tracer support mechanism supporting a tracer at a corner such that the tracer can be freely moved to trace a letter or the like engraved on a tracing plate, a parallelogrammic horizontal component transmission mechanism via an inclination angle setting mechanism and capable of transmitting only the horizontal component of the tracing motion of the tracer on an equal scale, an enlarged scale or a reduced scale and/or a preset inclination angle, a parallelogrammic vertical component transmission mechanism coupled to the tracer support mechanism and capable of transmitting only the vertical component of the tracing motion of the tracer on an equal scale, an enlarged scale or a reduced scale, a resultant motion reproducing mechanism coupled to the parallelogrammic horizontal and vertical component transmission mechanisms and capable of combining the horizontal and vertical components of tracer motion transmitted from the respective transmission mechanisms to reproduce the tracer motion on an equal scale, an enlarged scale or a reduced scale and/or the preset inclination angle, and a writing tool support mechanism coupled to the reproducing mechanism and capable of supporting a writing tool at a free end. With this lettering machine, it is possible to write letters on horizontally and/or vertically enlarged or reduced scales and also with desired inclination angles as well as ordinary equal scale letters.

10 Claims, 6 Drawing Figures

LETTERING MACHINE

The invention relates to a lettering machine for writing letters or the like by tracing letter patterns engraved on letter pattern plates and, more particularly, to a lettering machine, which can write enlarged scale letters, reduced scale letters and inclined letters as well as regular equal scale letters directly on drawing sheets for mechanical, electrical, constructional, measurement and other purposes, graphical cardboards, poster sheets, drawing films, overhead projector films, etc., with a writing tool such as an ink pen, a ball pen, a pencil, a sign pen, etc.

With prior art lettering machines, letters or the like are written directly in ink using drawing pens, but they cannot be written with a ball pen or a sign pen, and particularly with a pencil. Also, letters or the like once written cannot be easily corrected or erased.

Further, the scale can be enlarged or reduced only with equal horizontal and vertical magnifications, that is, it has been impossible to set different horizontal and vertical magnifications to write vertically or horizontally elongated letters. Still further, it has been impossible to write letters inclined to the left or right. Moreover, the scale enlarging/reducing mechanism has been rather large in size.

The primary object of the invention is to provide a lettering machine, with which a suitably selected writing tool such as an ink pen, a ball pen, a pencil, a sign pen, etc. can be used.

Another object of the invention is to provide a lettering machine, which can reproduce letters or the like engraved on letter pattern plates on an equal scale, an enlarged scale or a reduced scale and/or in an inclined form.

A further object of the invention is to provide a lettering machine, which can write letters or the like on an enlarged or reduced scale with different horizontal and vertical magnifications in a vertically or horizontally elongated form and/or in an inclined form.

The above and other objects of the invention will become more apparent from the following description when the same is read with reference to the accompanying drawings, in which.

An embodiment of the invention will now be described with reference to FIGS. 1 through 4. Referring to these Figures, there is shown a lettering machine generally designated at A according to the invention. The lettering machine A comprises a tracer support mechanism B, an inclination angle setting mechanism C, a parallelogrammic horizontal component transmission mechanism D, a parallelogrammic vertical component transmission mechanism E, a resultant motion reproducing mechanism F and a writing tool support mechanism G. The tracer support mechanism B supports a tracer 1 at a corner such that the tracer can be freely moved to trace a letter or the like (not shown) engraved on a tracing pattern plate $\alpha$. The parallelogrammic horizontal component transmission mechanism D is coupled to the tracer support mechanism B via the inclination angle setting mechanism C, and it can transmit the horizontal component of the tracing motion of the tracer on an equal scale, an enlarged scale or a reduced scale and/or with a desired inclination angle. The parallelogrammic vertical component transmission mechanism E is coupled directly to the tracer support mechanism B, and it can transmit the vertical component of the tracing motion of the tracer on an equal scale, an enlarged scale or a reduced scale. The parallelogrammic horizontal and vertical component transmission mechanisms D and E are disposed perpendicular to each other. The resultant motion reproducing mechanism F are coupled to both the parallelogrammic horizontal and vertical component transmission mechanisms D and E, and it can combine the horizontal and vertical components of tracer motion transmitted from the respective transmission mechanisms to reproduce the tracer motion on an equal scale, an enlarged scale or a reduced scale and/or with a desired inclination angle. The writing tool support mechanism G is coupled to the resultant motion reproducing mechanism F, and it can support a writing tool such as a drawing pen, a ball pen, a sign pen, a pencil and a fountain pen at a free end diagonally opposed to the tracer 1.

Figure 2:
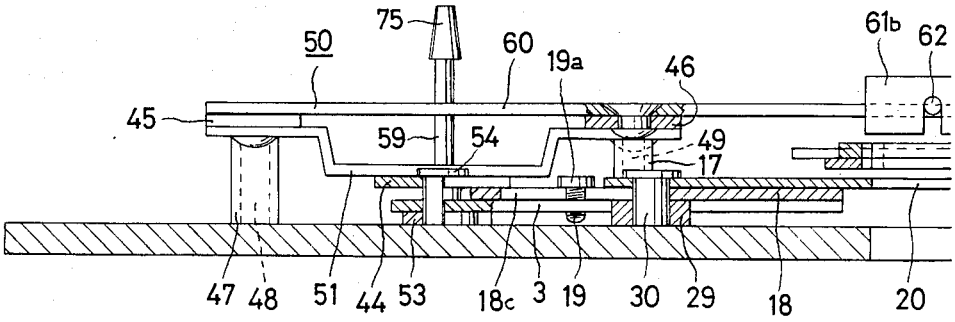
FIG. 2A is a left half portion of an enlarged-scale sectional view taken along line II—II in FIG. 1.
FIG. 2B is the right half portion of the same as the above.
Figure 2:
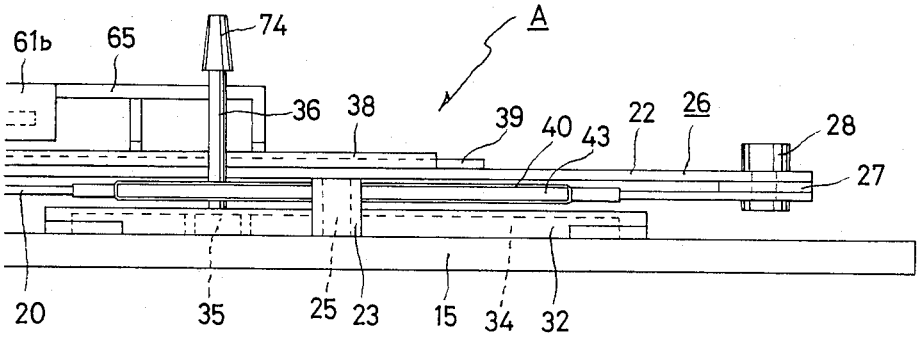
Figure 3:
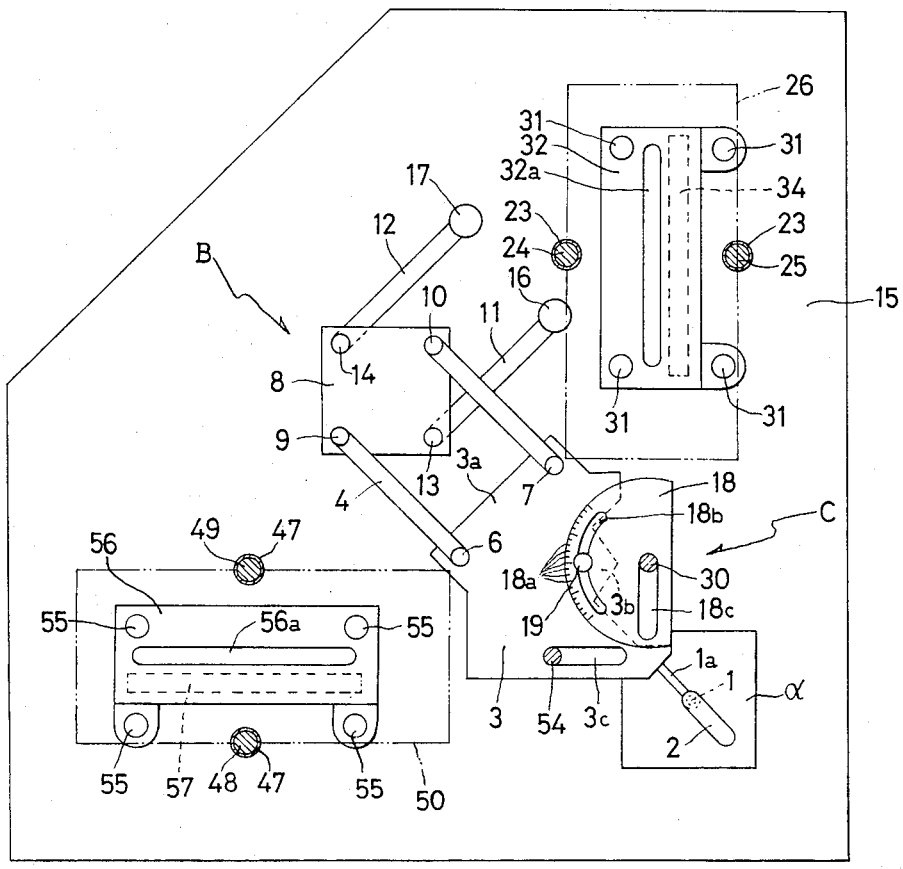
FIG. 3 is a schematic plan view showing the same embodiment as in FIG. 1 but with some components removed.
Figure 4:
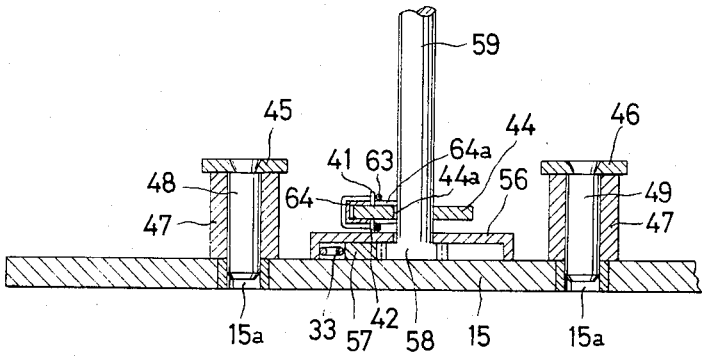
FIG. 4 is an enlarged-scale sectional view taken along line IV—IV in FIG. 1.

The tracer support mechanism B, as shown in FIGS. 2 and 3, includes a coupling member 3 which has a mounting rod 1*a* projecting from a corner thereof in the same direction. The mounting rod 1*a* supports a tracer 1 projecting from its tip perpendicularly, i.e., downwards. The tracer 1 has a grip 2 provided at the upper end. A pair of parallel links 4 and 5 linked at their one end to pins 6 and 7 projecting from corners of a diagonal side portion 3*a* of the coupling member 3. These links 4 and 5 are linked at their other end to pins 9 and 10 projecting from diagonal corners of an intermediate square coupling member 8. A pair of second parallel links 11 and 12 are linked at their one end to pins 13 and 14 projecting from the other diagonal corners of the intermediate square coupling member 8 and linked at the other end to pins 16 and 17 projecting from a base member 15.

Figure 1:
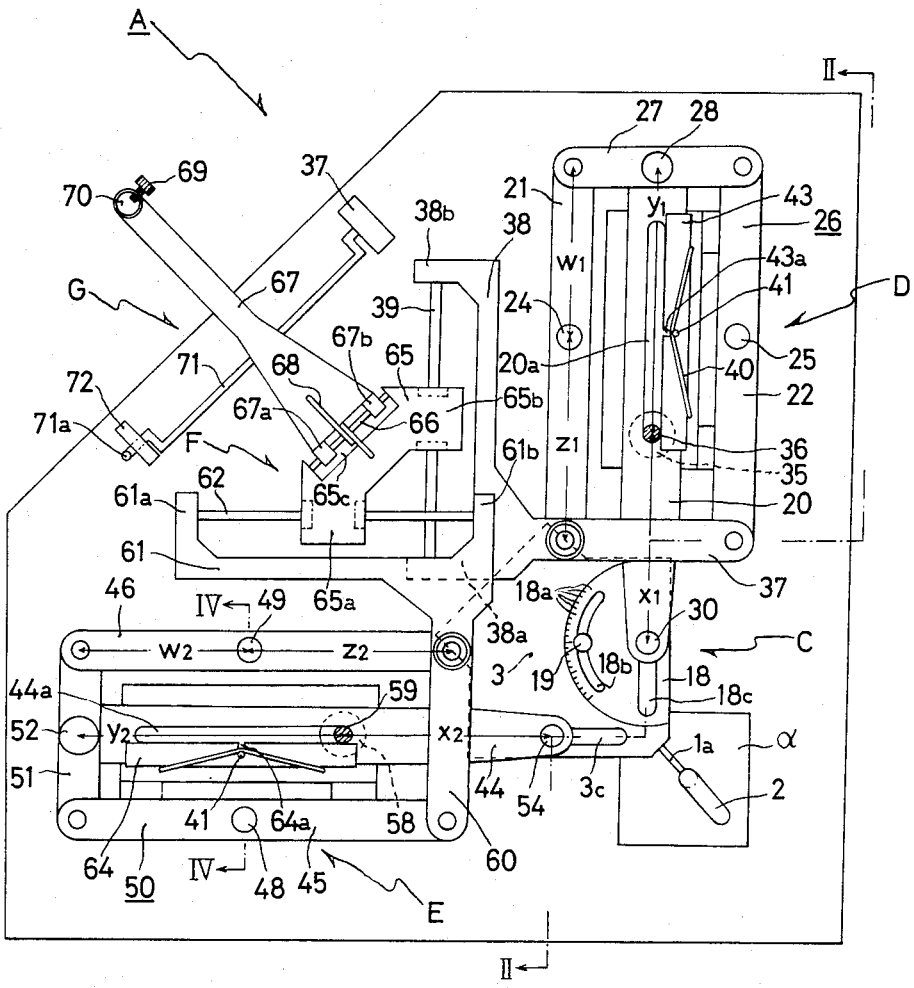
FIG. 1 is a schematic plan view showing an embodiment of the invention.

The inclination angle setting mechanism C, as shown in FIGS. 1 through 3, includes a semi-circular scale member 18 which has an arcual slot 18*b* formed along its arcular edge having a scale 18*a*. An inclination angle setting screw 19 projects from a central portion 3*b* of a W-shaped right side portion of the coupling member 3, and penetrates the arcular slot 18*b*. The semi-circular scale member 18 can be held at a fixed position relative to the coupling member 3 at a desired angle thereto by clamping the inclination angle setting screw 19 at a corresponding position in the arcual slot 18*b*.

The parallelogrammic horizontal component transmission mechanism D, as shown in FIGS. 1 through 3, includes a parallelogrammic link assembly 26 consisting of a pair of parallel long links 21 and 22 and a pair of parallel short links 27 and 37. The long links 21 and 22 have their central portions linked to pins 24 and 25 projecting from the base member 15. An bushing or sleeve 23 is fitted on each of the pins 24 and 25. An interlocked adjustment member 20 is linked at one end to a pin 28 projecting from a central portion of the short link 27 of the parallelogrammic link assembly 26. It extends in the longitudinal direction of the long links 21 and 22. It has a slide pin 30 projecting from its other end. The slide pin 30 perpendicularly penetrates a guide slot 18c formed in the semi-circular scale member 18 along the straight edge thereof and is movable along the guide slot 18c. A slide ring 29 is fitted on the lower end of the slide pin 30. A horizontal magnification adjustment pin 36 penetrates a guide slot 20a formed in the interlocked adjustment member 20 and extending in the longitudinal direction thereof. It also penetrates a magnification setting slot 32a formed in a central portion of a rack accommodating member 32 and overlapping the guide slot 20a. The rack accommodating member 32 is secured at its four corners by screws 31 to the base member 15 and accommodates a rack 34 extending in the longitudinal direction of the interlocked adjustment member 20. The horizontal magnification adjustment pin 36 has a pinion 35 secured to its stem end and meshing with the rack 34. It is urged from the back side by a back-up spring 33. A channel-shaped guide rod holder 38 is integrally coupled to the left end of the short link 37 of the parallelogrammic link assembly 26. A guide rod 39 is supported between leg portions 38a and 38b of the guide rod holder 38 and extends in the longitudinal direction of the long links of the parallelogrammic link assembly 26.

The interlocked adjustment member 20 has spring retainer pins 41 and 42 projecting from its top and bottom surface adjacent to one edge of a central portion of the guide slot 20a. The spring retainer pins 41 and 42 received in notches 43a formed in a channel-shaped member 43 fitted on the corresponding side portion of the interlocked adjustment member 20. The channel-shaped member 43 is urged against the horizontal magnification adjustment pin 36 by a spring 40 to elminate rattling of the pin 36.

The parallelogrammic vertical component transmission mechanism E, as shown in FIGS. 1 through 4, includes a parallelogrammic link assembly 50 consisting of a pair of parallel long links 45 and 46 and a pair of parallel short links 51 and 60. The long links 45 and 46 have their central portions linked to pins 48 and 49 projecting from the base member 15. An outer pipe 47 is fitted on each of the pins 48 and 49. An interlocked adjustment member 44 is linked at one end to a pin 52 projecting from a central portion of the short link 51 of the parallelogrammic link assembly 50. It extends in the longitudinal direction of the long links 48 and 49. It has a slide pin 54 projecting from its other end. The slide pin 54 perpendicularly penetrates a guide slot 3c formed in the coupling member 3 and extending along the edge thereof extending in the longitudinal direction of the interlocked adjustment member 44, and is movable along the guide slot 3c. A slide ring 53 is fitted on the lower end of the slide pin 54. A vertical magnification adjustment pin 59 penetrates a guide slot 44a formed in the interlocked adjustment member 44 and extending in the longitudinal direction thereof. It also penetrates a magnification setting slot 56a formed in a central portion of a rack accommodating member 56 and overlapping the guide slot 44a. The rack accommodating member 32 is secured at its four corners by screws 55 to the base member 15 and accommodates a rack 57 extending in the longitudinal direction of the interlocked adjustment member 44. The vertical magnification adjustment pin 59 has a pinion 58 secured to its stem end and meshing with the rack 57. It is urged from the back side by a back-up spring 33. A channel-shaped guide rod holder 61 is integrally coupled to the left end of the short link 60 of the parallelogrammic link assembly 50. A guide rod 62 is supported between leg portions 61a and 61b of the guide rod holder 61 and extends in the longitudinal direction of the long links of the parallelogrammic link assembly 50.

The interlocked adjustment member 44 has spring retainer pins 41 and 42 projecting from its top and bottom surfaces adjacent to one edge of a central portion of the guide slot 44a. The spring retainer pins 41 and 42 are received in notches 64a formed in a channel-chaped member 64 fitted on the corresponding side portion of the interlocked adjustment member 44. The channel-shaped member 64 is urged against the vertical magnification adjustment pin 59 by a spring 63 to eliminate rattling of the pin 59.

The resultant motion reproducing mechanism F, as shown in FIGS. 1, 2A and 2B, includes a resultant motion slider 65, which has both wing portions 65a and 65b slidably fitted at right angle on the guide rods 39 and 62 of the parallelogrammic horizontal and vertical component transmission mechanisms D and F respectively.

The writing tool support mechanism G, as shown in FIG. 1, includes a writing tool holder 67, which has a bifurcated stem having two leg portions 67a and 67b rotatably fitted on a mounting rod 66 bridging a recess formed in an end portion of the resultant motion slider 65. A torsion spring 68 is wound on a central portion of the mounting rod 66. Its one end engages with the resultant motion slider 65, and its other end engages with the bifurcated stem of the writing tool holder 67. It biases the writing tool holder 67 to urge a writing tool supported by the end thereof against a writing medium. A writing tool is inserted in a mounting hole formed at the tip of the writing tool holder 67 and secured in position by clamping a set screw 69 sidewise.

Reference numeral 71 designates a writing tool holder erecting lever with the opposite ends thereof rotatably supported in bearing blocks 72 and 73 secured to the base member 15 adjacent to an edge thereof formed by cutting off a corner portion diagonally opposite the corner adjacent to the tracer support mechanism B. It has an integral handle 71a. When the handle 71a is turned upright the erecting lever 71 is turned down, whereby the writing tool holder 67 is released from its lower support and turned by the biasing force of the torsion spring 68 to bring the top of a writing tool (not shown) set in the writing tool mounting hole 70 of the holder 67 into forced contact with a writing medium such as a paper sheet. The writing tool is now ready to write letters or the like on the paper sheet. When the handle 71a is turned down, to the edge noted above, the lever 71 is erected to erect the writing tool holder 67 against the spring force of the spring 68 to separate the tip of the writing tool from the paper sheet and bring it to a stand-by position.

When using the lettering machine of the construction described above, the writing tool holder 67 is first erected by turning down the handle 71a of the writing tool holder erecting lever 71. Then a writing tool having a suitable tip selected according to the thickness, mode, etc. of the letter patterns to be written is set in the writing tool holder 67 by inserting it into the writing tool hole 70 from above and securing it in position by clamping the set screw 69 such that its tip is spaced apart from the paper sheet or the like.

Then, the horizontal magnification adjustment pin 36 of the parallelogrammic horizontal component transmission mechanism D is moved by holding its grip 74 along the horizontal magnification setting slot 32*a* to a position corresponding to a desired horizontal magnification.

The horizontal magnification $M_H$ is given as $$M_H = \frac{y_1(\text{variable})}{x_1(\text{variable})} \times \frac{z_1(\text{fixed})}{w_1(\text{fixed})}$$

Also, the vertical magnification adjustment pin 59 of the parallelogrammic vertical component transmission mechanism E is moved by holding its grip 75 along the vertical magnification setting slot 56*a* to a position corresponding to a desired vertical magnification.

The vertical magnification $M_V$ is given as $$M_V = \frac{y_2(\text{variable})}{x_2(\text{variable})} \times \frac{z_2(\text{fixed})}{w_2(\text{fixed})}$$

When it is desired to write inclined letters, the desired inclination angle is set by operating the inclination angle setting mechanism C. More specifically, the grip or knob 19*a* of the inclination angle setting screw 19 is loosened once, and then the semi-circular scale member 18 is rotated unitl the screw 19 comes to correspond to a desired angle graduation of the scale 18*a*. Thereafter, the inclination angle setting screw 19 is clamped again to secure the semi-circular scale member 18 to the coupling member 3. Now, letters inclined to the left or right by the desired angle set in the above way can be written.

After the above preparations are completed, a paper sheet or the like (not shown) is placed beneath the writing tool (not shown) and appropriately positioned relative thereto. Also, a letter pattern plate $\alpha$ with a desired letter or the like engraved on the surface is set on a letter pattern plate holder (not shown) provided beneath the tracer 1. Subsequently, the writing tool holder erecting lever 71 is turned down to release the lower support to the writing tool holder 67 by turning the handle 71*a* upright. The writing tool holder 67 is thus turned down by the biasing force of the torsion spring 68 and also by the weight of its own, so that the tip of the writing tool is brought into forced contact with the surface of the paper sheet or the like.

Now, grooves of a letter pattern or the like formed in the letter pattern plate $\alpha$ are traced with the tracer 1 while applying an urging force thereto. At this time, the parallelogrammic horizontal component tranmission mechanism D transmits the horizontal component of the tracing motion of the tracer 1 on the preset horizontal scale and with the preset inclination angle. Also, the parallelogrammic vertical component transmission mechanism E transmits the vertical component of the tracing motion of the tracer 1 on the preset vertical scale. The resultant motion reproducing mechanism F, which includes the resultant motion slider 65 coupled to both the guide rods 39 and 62 as the output sections of the respective parallelogrammic horizontal and vertical component transmission mechanisms D and E, combines the transmitted horizontal component of the tracing motion on the preset horizontal scale and with the preset inclination angle and the transmitted vertical component of the tracing motion on the preset vertical scale. The writing tool holder 67 which is integral with the resultant motion slider 65 follows the motion thereof, whereby the reproduced letter or the like is written on the paper sheet or the like by the writing tool supported at the free end of the writing tool holder 67.

When a line as an element of the letter of the like has been written, the handle 71*a* is turned down again, and if a next line is to be written, the tracer 1 is brought to the start point of the next line and the line is traced by turning the handle 71*a* upright again.

In the above way, regular scale letters, vertically elongated letters, horizontally elongated letters and inclined letters can be written desirably.

Figure 5:
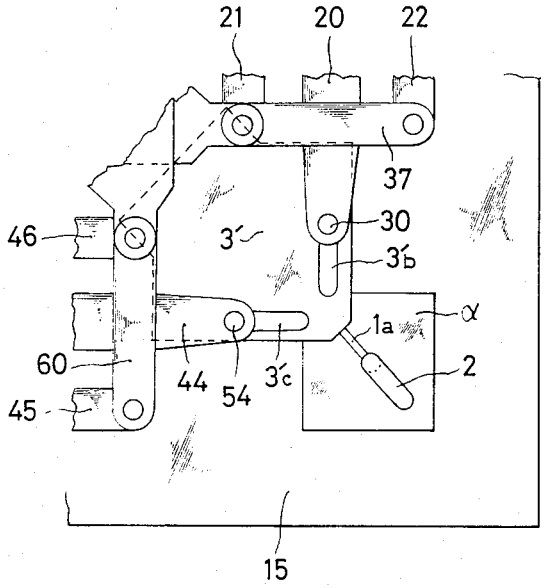
FIG. 5 is a fragmentary plan view showing a different embodiment of the invention.

FIG. 5 shows a different embodiment of the invention, which permits writing of only regular scale proportion letters, vertically elongated letters and horizontally elongated letters. This embodiment is the same as the preceding embodiment except for that the semi-circular scale member 18 is omitted, the coupling member 3 is replaced with a coupling member 3' having perpendicular guide slots 3'*b* and 3'*c* extending along perpendicular edges, and slide pin 30 projecting from interlocked adjustment member 20 penetrates the guide slot 3'*b*. Like parts are designated by like reference numerals. The operation is also the operation in the preceding embodiment except for that there is no inclinating angle setting operation.

As has been described in the foregoing, according to the invention letters or the like can be written on an enlarged or reduced scale with different horizontal and vertical magnifications in a vertically or horizontally elongated form as well as on the regular equal scale. Also, a desired inclination angle can be set by manipulating the grip or knob provided on the inclination angle setting mechanism C. Further, letters of various types can be written by preparing the corresponding fonts of letter pattern plates $\alpha$. Of course alphabet letters can be written by preparing desired fonts of letters. Further, the letters or the like can be written in a horizontal line or in a vertical line by correspondingly setting letter pattern plates $\alpha$.

According to the invention, aesthetical letters can be written on whatever drawing sheets for mechanical, electrical, constructional, measurement and other purposes. Further, lettering machine according to the invention can be used for writing letters on graphs, cardboards, posters, drawing films, overhead projector films etc. directly in ink. Furthermore, it is possible to use color inks. Further, no limitation is imposed on the size of drawings or films on which to write letter or the like. Further, it is possible to write letters or the like with a pencil, which has heretofore been impossible.

What is claimed is:

1. A lettering machine comprising:

a tracer support mechanism means supporting a tracer means at a corner such that said tracer means can be freely moved to trace a letter or the like engraved on a tracing pattern plate;

a parallelogrammic horizontal component transmission mechanism means coupled directly to said tracer support mechanism means and capable of transmitting the horizontal component of the tracing motion of said tracer means on an equal scale, an enlarged scale or a reduced scale;

a parallelogrammic vertical component transmission mechanism means coupled to said tracer support mechanism means and capable of transmitting the vertical component of the tracing motion of said tracer means on an equal scale, an enlarged scale or a reduced scale;

a resultant motion reproducing mechanism means coupled to said parallelogrammic horizontal and vertical component transmission mechanism means and capable of combining the horizontal and vertical components of tracer motion transmitted from said respective transmission mechanism means to reproduce the tracer motion on an equal scale, an enlarged scale or a reduced scale; and a writing tool support mechanism means coupled to said resultant motion reproducing mechanism means and capable of mounting a writing tool at a free end.

2. A lettering machine comprising:

a tracer support mechanism means supporting a tracer means at a corner such that said tracer means can be freely moved to trace a letter or the like engraved on a tracing pattern plate;

a parallelogrammic horizontal component transmission mechanism means coupled to said tracer support mechanism means via an inclination angle setting mechanism means and capable of transmitting the horizontal component of the tracing motion of said tracer means on an equal scale, an enlarged scale or a reduced scale and/or a desired inclination angle;

a parallelogrammic vertical component transmission mechanism means coupled to said tracer support mechanism means and capable of transmitting the vertical component of the tracing motion of said tracer means on an equal scale, an enlarged scale or a reduced scale;

a resultant motion reproducing mechanism means coupled to said parallelogrammic horizontal and vertical component transmission mechanism means and capable of combining the horizontal and vertical components of tracer motion transmitted from said respective transmission mechanism means to reproduce the tracer motion on an equal scale, an enlarged scale or a reduced scale and/or a desired inclination angle; and a writing tool support mechanism means coupled to said resultant motion reproducing mechanism means and capable of supporting a writing tool at a free end.

3. The lettering machine according to claim 2, wherein said tracer support mechanism means includes a coupling member means carrying said tracer means projecting perpendicularly thereto at a corner thereof, said tracer means having a grip means provided at an end, a pair of first parallel link means linked at one end to said coupling member means at opposed corners thereof, an intermediate square coupling member means, said first parallel link means being linked at the other end to said intermediate square coupling member means at diagonal corners thereof, and a pair of second parallel link means linked at one end to said intermediate square coupling member means at the other opposed corners thereof, said second parallel link means being pivotally coupled at the other end to a stationary member means.

4. The lettering machine according to claim 2, wherein said inclination angle setting mechanism means includes a semi-circular scale member means having an arcular slot means formed along the arcular edge and an inclination angle setting screw means projecting from a right side portion of said coupling member means of said tracer support mechanism means and penetrating said arcular slot means, said semi-circular scale member means being capable of being held at a fixed position relative to said coupling member means at a desired angle thereto by clamping said inclination angle setting screw means at a corresponding position in said arcular slot means.

5. The lettering machine according to claim 2, wherein said parallelogrammic horizontal component transmission mechanism means includes a parallelogrammic link assembly means consisting of a pair of parallel long link means and a pair of parallel short link means, said long link means being each linked at a central portion to a stationary member means, an interlocked adjustment member means having one end linked to a central portion of one of said short link means more remote from said tracer support mechanism means and extending in the longitudinal direction of said long link means of said parallelogrammic link assembly means, said interlocked adjustment member means having a slide pin means projecting from the other end and perpendicularly penetrating and movable along a guide slot means formed in said semi-circular scale member means along the straight endge thereof, a horizontal magnification adjustment pin means perpendicularly penetrating a guide slot means formed in said interlocked adjustment member means and extending in the longitudinal direction thereof, said horizontal magnification adjustment pin means having a pinion means secured to a stem end thereof, said pinion means being in mesh with a rack means extending in the vertical direction of said interlocked adjustment member means, a guide rod holder means integrally coupled to the left end of said short link means of said parallelogrammic link assembly means nearer said tracer support mechanism means, and a guide rod means supported by said guide rod holder means and extending in the longitudinal direction of said long link means.

6. The lettering machine according to claim 2, wherein said parallelogrammic vertical component transmission mechanism means includes a parallelogrammic link assembly means consisting of a pair of parallel long link means and a pair of parallel short link means, said long link means being each linked at a central portion to a stationary member means, an interlocked adjustment member means having one end linked to a central portion of one of said short link means more remote from said tracer support mechanism means and extending in the longitudinal direction of said long link means of said parallelogrammic link assembly means, said interlocked adjustment member means having a slide pin means projecting from the other end and perpendicularly penetrating and movable along a guide slot means formed in said coupling member means of said tracer support mechanism means along the edge thereof extending in the longitudinal direction of said interlocked adjustment member meansm a vertical magnification adjustment pin means perpendicularly penetrating a guide slot means formed in said interlocked adjustment member means and extending in the longitudinal direction thereof, said vertical magnification adjustment pin means having a pinion means secured to a stem end thereof, said pinion means being in mesh with a rack means extending in the horizontal direction of said interlocked adjustment member means, a guide rod holder means integrally coupled to the left end of the short link means of said parallelogrammic link assembly means nearer said tracer support mechanism means, and a guide rod means supported by said guide rod holder means and extending in the longitudinal direction of said long link means.

7. The lettering machined according to claim 2, wherein said parallelogrammic horizontal and vertical component transmission mechanism means are disposed perpendicular to each other.

8. The lettering machine according to claim 2, wherein said resultant motion reproducing mechanism includes a resultant motion slider means having both wing portions slidably fitted at right angle on said respective guide rod means of said parallelogrammic horizontal and vertical component transmission mechanism means.

9. The lettering machine according to claim 2, wherein said writing tool support mechanism includes a writing tool holder means having a bifurcated stem rotatably fitted on a mounting rod means bridging a recess formed in an end portion of said resultant motion slider means of said resultant motion reproducing mechanism means and a torsion spring means wound on a central portion of said mounting rod means and having one end engaging with said resultant motion slider means and the other end engaging with said bifurcated stem of said writing tool holder means, said torsion spring means biasing said writing tool holder means to urge the tip of a writing tool means supported by said writing tool holder means against a writing medium.

10. The lettering machine according to claim 2, wherein said writing tool means supported by the free end of said writing tool support mechanism means is selected from amoung a drawing pen, a ball pen, a sign pen, a pencil and a fountain pen.

* * * * *